US012715658B2

(12) United States Patent
Williams

(10) Patent No.: US 12,715,658 B2
(45) Date of Patent: Aug. 25, 2026

(54) SEALABLE STORAGE BAG

(71) Applicant: Sazza Inc., San Francisco, CA (US)

(72) Inventor: Peter Williams, Alameda, CA (US)

(73) Assignee: Sazza, Inc., San Francisco, CA (US)

( * ) Notice: Subject to any disclaimer, the term of this patent is extended or adjusted under 35 U.S.C. 154(b) by 118 days.

(21) Appl. No.: 18/737,790

(22) Filed: Jun. 7, 2024

(65) Prior Publication Data

US 2024/0409275 A1 Dec. 12, 2024

Related U.S. Application Data

(60) Provisional application No. 63/507,253, filed on Jun. 9, 2023.

(51) Int. Cl.
*B65D 33/24* (2006.01)

(52) U.S. Cl.
CPC ..... *B65D 33/243* (2013.01); *B65D 2313/04* (2013.01)

(58) Field of Classification Search
CPC ..... B65D 33/243; B65D 2313/04
USPC ..... 383/86, 63
See application file for complete search history.

(56) References Cited

U.S. PATENT DOCUMENTS

| | | | | |
|---|---|---|---|---|
| 3,326,399 | A * | 6/1967 | Ausnit | A41F 1/002 428/323 |
| 4,588,209 | A * | 5/1986 | Zebrowski | B42F 11/04 402/503 |
| 5,113,555 | A * | 5/1992 | Wilson | B65D 77/065 24/584.1 |
| 6,899,460 | B2 * | 5/2005 | Turvey | B65D 33/2508 383/33 |
| 11,535,440 | B2 * | 12/2022 | Huffer | B65D 33/22 |
| 12,527,384 | B2 * | 1/2026 | Fiedler | A45C 13/1069 |
| 2013/0061431 | A1 * | 3/2013 | Naftali | A45C 13/1069 24/303 |
| 2015/0196955 | A1 * | 7/2015 | Naftalin | B22F 5/006 264/401 |
| 2017/0275056 | A1 * | 9/2017 | Boudouris | B29C 65/48 |
| 2018/0148225 | A1 * | 5/2018 | Vandamme | B65D 33/2508 |
| 2021/0221591 | A1 * | 7/2021 | Huffer | B65D 75/5855 |
| 2023/0150745 | A1 * | 5/2023 | Tamarindo | B29C 45/2612 383/42 |
| 2026/0076482 | A1 * | 3/2026 | Lian | A47C 4/54 |

* cited by examiner

*Primary Examiner* — Peter N Helvey
(74) *Attorney, Agent, or Firm* — Merchant and Gould, PC

(57) ABSTRACT

Disclosed herein is a storage bag that includes a tongue and groove sealing feature that provides a seal at the top of the bag to prevent the contents of the bag from leaking therefrom. In some implementations, the tongue and groove may include a plurality of magnets that may aid in sealing the bag and may also aid in self-sealing the tongue into the groove. In some implementations, the disclosed storage bag may include tabs configured such that applied forces may cause the bag to open/unseal.

12 Claims, 10 Drawing Sheets

SEALABLE STORAGE BAG

CROSS-REFERENCE TO RELATED APPLICATION

This application claims priority to U.S. Provisional Patent Application Ser. No. 63/507,253, filed Jun. 9, 2023, the disclosure of which is incorporated herein by reference in its entirety.

BACKGROUND

Sealable storage bags may be utilized to hold may types of items, including food items and materials that may include liquid components. These storage bags may not seal completely or may become unsealed easily, leading to leaks or other loss of containment. Additionally, these bags may be difficult to open and may require the use of two hands to open.

SUMMARY

A user may wish to store materials, for example, food materials, in a sealable storage bag. The user may desire a flexible bag that seals completely, reduces or eliminates leaks, and is able to be resealed once opened. In some implementations, the disclosed storage bag may include tongue and groove sealing feature that provides a seal at the top of the bag to prevent the contents of the bag from leaking therefrom. In some implementations, the tongue and groove may include a plurality of magnets that may aid in sealing the bag and may also aid in self-sealing the tongue into the groove. In some implementations, the disclosed storage bag may include tabs configured such that applied forces may cause the bag to open/unseal.

In accordance with aspects of the disclosure, a storage bag comprises: a flexible pouch comprising an open top defined by two sides of the flexible pouch; and a seal assembly secured to the open top of the pouch, the seal assembly comprising: a pair of lips, wherein each lip of the pair of lips is secured to one side of the open top of the pouch, and wherein the pair of lips are joined together at a first end and a second end of each lip of the pair of lips, wherein the pair of lips comprises: a front lip comprising: a tongue extending along the front lip, the tongue comprising an upper engaging surface, a lower engaging surface, a leading edge, and a trailing edge, wherein the tongue is attached to the front lip at the trailing edge, and wherein the leading edge has a leading edge height that is greater than a trailing edge height; a front tab extending from the front lip; and a plurality of front magnets disposed within the tongue adjacent to the leading edge of the tongue; and a rear lip comprising: a groove extending along the rear lip, the groove comprising an upper receiving surface, a lower receiving surface, a base, and a mouth having a mouth height less than a base height of the base; a rear tab extending from of the rear lip; and a plurality of rear magnets disposed within the groove adjacent to the base of the groove, wherein each one of the plurality of front magnets aligns with a corresponding one of the plurality of rear magnets.

In an aspect, the front contact surface of the front lip and a rear contact surface of the rear lip contact at an interface.

In an aspect, the tongue is disposed within the groove, the plurality of front magnets and the plurality of rear magnets are located on a first side of the interface.

In an aspect, when the tongue is disposed within the groove, the upper engaging surface mates with the upper receiving surface, the lower engaging surface mates with the lower receiving surface, and the leading edge engages with the base.

In an aspect, the front tab comprises a front tab width less than a front lip width of the front lip, and wherein the rear tab comprises a rear tab width less than a rear lip width of the rear lip.

In an aspect, the flexible pouch comprises a closed bottom.

In an aspect, the storage bag further comprises a vertical axis, wherein at least a portion of the front tab and at least a portion of the rear tab are each positioned on both sides of the vertical plane.

In an aspect, when the tongue is disposed within the groove, a portion of the front tab overlaps with a portion of the rear tab.

In an aspect, when the tongue is disposed within the groove, at least a portion of the rear tab is disposed in front of at least a portion of the front tab.

In an aspect, the front lip, the front tab, and the tongue comprise a unitary part, and the rear lip and the rear tab comprise a unitary part, and wherein the rear lip defines the groove.

In an aspect, the tongue and groove each comprise a trapezoidal profile.

In an aspect, the mouth height is approximately 70% of the base height.

In accordance with aspects of the disclosure, a method of opening a sealed bag comprises: applying a rearward force to a rear tab of a rear lip of the sealed bag, the rear lip comprising a groove and a plurality of rear magnets disposed adjacent a base of the groove; applying a frontward force to a front tab of a front lip of the sealed bag, the front lip comprising a tongue disposed within the groove, and a plurality of front magnets disposed adjacent a leading edge of the tongue, wherein each one of the plurality of front magnets is magnetically engaged with a corresponding one of the plurality of rear magnets, and wherein, prior to applying the rearward force and the frontward force, at least a portion of the rear tab is disposed in front of at least a portion of the front tab, and wherein the frontward force is applied in a direction substantially opposite to and offset from to the rearward force; disengaging the rear tab from the front tab upon application of the rearward force and the frontward force; and subsequent to disengaging the rear tab from the front tab, separating at least a portion of the tongue from the groove, wherein the separated portion is disposed between the rear tab and the front tab.

In an aspect, the method further comprises: upon application of the rearward force and the frontward force, disengaging an upper engaging surface of the tongue from an upper receiving surface of the groove.

In an aspect, the method further comprises: upon application of the rearward force and the frontward force, separating an upper portion of a front contact surface of the front lip from an upper portion of a rear contact surface of the rear lip, wherein the upper portion of the front contact surface is located above the tongue, and wherein the upper portion of the rear contact surface is located above the groove.

In an aspect, the method further comprises: disengaging at least one pair of the plurality of front magnets and plurality of rear magnets.

In an aspect, the method further comprises: terminating application of the rearward force and the frontward force, wherein the termination magnetically engages the tongue within the groove.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Examples may be practiced as methods, systems, or devices. The following detailed description is therefore not to be taken in a limiting sense, and the scope of the present disclosure is defined by the appended claims and their equivalents.

A user may wish to store materials, for example, food materials, in a scalable storage bag. The user may desire a bag that seals completely so as to reduce or eliminate leaks, and is able to be rescaled once opened. The scalable storage bag may include a variety of features and may be configured in any number of form factors. In some examples, the bag is flexible. The sealing feature may be manipulated from a closed configuration to an open configuration with the use of only one hand. Once open, the sealing feature may be released by the user so that the bag may self-seal. A self-sealing/self-healing configuration as described herein has particular advantages, because as the two sides of the bag opening are drawn together (for example, magnets drawing a tongue into a groove or channel), the bag can be fully closed without the need for external pressure. In such a configuration, the tongue cannot be misaligned with the wrong groove, and features such as magnets ensure proper placement of the two sides of the bag. The bag may have a bottom thereof that enables it to stand upright on a surface. The user may additionally wish to utilize a bag that is re-usable to reduce personal and environmental waste.

The disclosed scalable storage bag may include tongue and groove sealing feature that provides a seal at the top of the bag to prevent the contents of the bag from leaking out. The tongue and groove may include a plurality of magnets that aid in sealing the bag and may also aid in self-sealing the tongue into the groove. In some implementations, the disclosed storage bag has tabs configured such that applied forces may cause the bag to open/unseal. In certain implementations, the tabs are configured to allow for one-handed opening by a user. The storage bag may be available to consumers in various sizes. Standard sizes may be available by storage volume (for example, gallon, half-gallon, quart, pint, etc.) or other names relating to suggested size (for example snack, sandwich, etc.).

Figure 1:
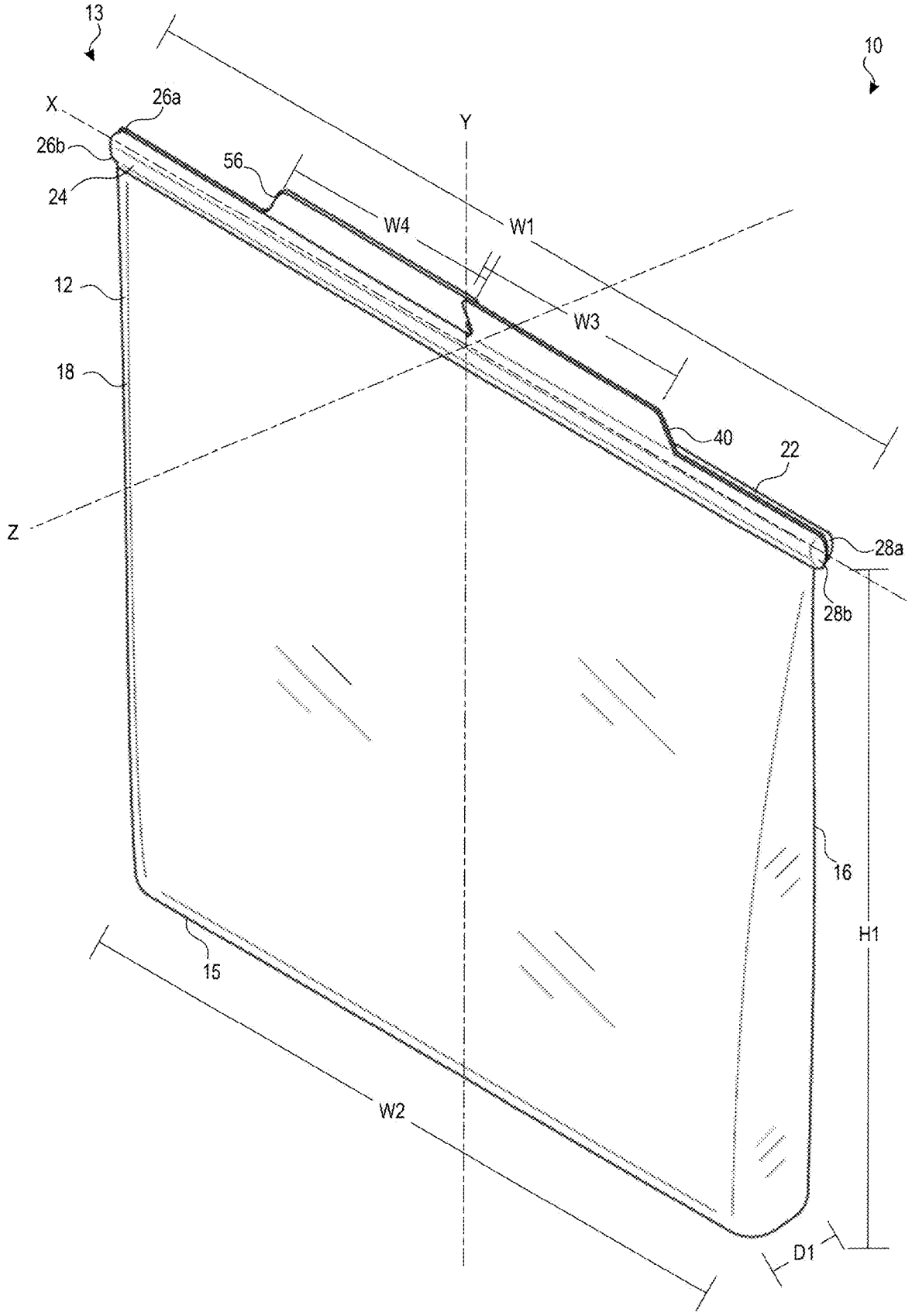
FIG. 1 illustrates a top perspective view of a sealable storage bag in a sealed configuration, according to an example.
Figure 2:
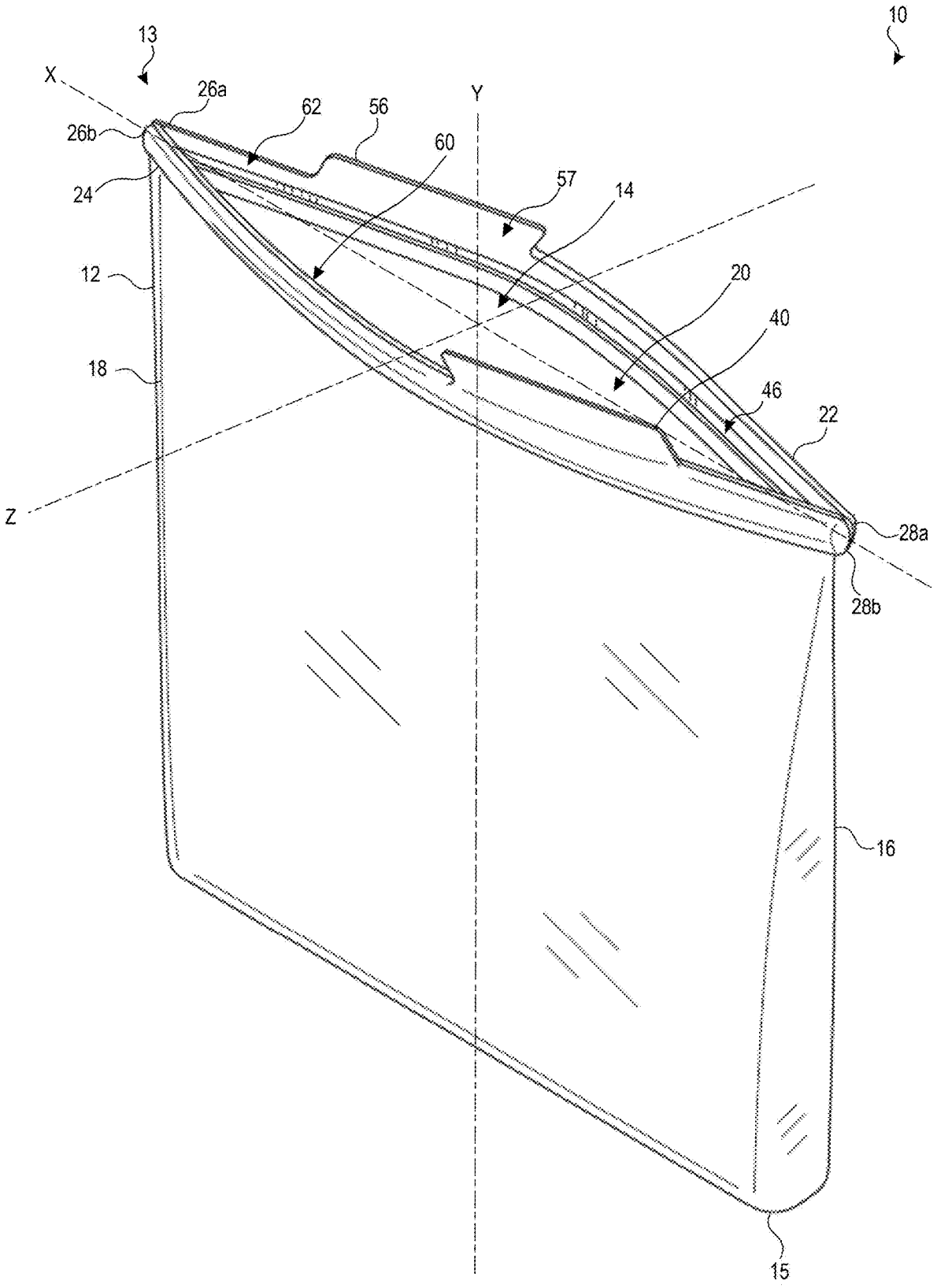
FIG. 2 illustrates a top perspective view of the storage bag of FIG. 1 in an open configuration.

FIG. 1 illustrates a top perspective view of a scalable storage bag 10 in a sealed configuration. FIG. 2 illustrates a top perspective view of the sealable storage bag 10 in an open configuration. FIGS. 1 and 2 are described concurrently and not all components described are visible in both FIG. 1 and FIG. 2. Storage bag 10 may include a flexible pouch 12 that includes a closed bottom 15, a rear side 16, an open top 14, and a front side 18. The closed bottom 15, a rear side 16, the open top 14, and a front side 18 define an interior volume 20 of the storage bag 10 that may be utilized for storage of various items/materials. Materials stored within the interior volume 20 may include food materials, non-food materials, solid materials, liquid materials, or any other materials a user wishes to store. In some examples, the flexible pouch 12 is made of a flexible polymer, such as a plastic, rubber, or silicone material. Such a flexible polymer may have numerous advantages, including being reusable and washable. The flexible pouch 20 may be opaque, transparent, or translucent. The rear side 16 and front side 18 may be formed as a single part. The rear side 16 and front side 18 may be joined at a smooth seam. The rear side 16 and front side 18 may be joined at a raised seam. Closed bottom 15 may form a flat surface allows the storage bag 10 to stand upright.

A seal assembly 13 is secured to the open top 14 of the flexible pouch 12. The seal assembly 13 includes a pair of lips, including a rear lip 22 and front lip 24. The rear lip 22 and front lip 24 are connected at a rear lip first end 26*a* and a front lip first end 26*b*, as well as at a rear lip second end 28*a* and a front lip second end 28*b*. In some examples, the rear lip 22 and front lip 24 may be made of a flexible polymer, such as a plastic, rubber, or silicone material. In some examples, the rear lip 22 and front lip 24 may be the same material as the flexible pouch 12. In some examples, the rear lip 22 and front lip 24 may be the same material as the flexible pouch 12, and may be configured so as to display greater rigidity than the pouch 12, so as to enable opening thereof with a single hand.

The front lip 24 includes a tongue 30 that protrudes from a front lip contact surface 60 and that extends along the length of the front lip 24 between the front lip first end 26*b* and the front lip second end 28*b*. The rear lip 22 incudes a groove 46 recessed into a rear lip contact surface 62 and that extends along the length of the rear lip 22 between the rear lip first end 26*a* and the rear lip second end 28*a*.

For illustrative purposes, storage bags described herein may be described in relation to axes X, Y, and Z, and the planes defined by them. In FIGS. 1 and 2, Axis X extends along a width of the front lip 24 and rear lip 22, Axis Y extends along a height of the storage bag 10, and Axis Z extends along a depth of the storage bag 10. The storage bag 10 has a top bag width W1 and a bottom bag width W2, both of which are parallel to axis X. In some examples, the top bag width W1 and bottom bag width W2 are equal. In some examples, the top bag width W1 is greater than the bottom bag width W2, which may enable insertion of larger items into the flexible pouch 12 when the seal assembly 13 is open. In other examples, the top bag width W1 is less than the bottom bag width W2, thereby giving the storage bag a tapered appearance. The storage bag 10 has a bag height H1, parallel to axis Y. The front lip 24 and rear lip 22 extend or project above the bag height H1, for example, by a seal height H2. The top bag width W1 and bag height H1 may be equal, giving the bag 10 a generally square appearance. In some examples, the top bag width W1 is greater or less the bag height H1, making a bag so configured particularly well suited to receiving documents for storage in either a portrait or landscape orientation. The storage bag 10 has a depth D1 at the closed bottom 15 of the flexible pouch 12, parallel to axis Z.

In certain implementations, the storage bag 10 may be available to consumers in various sizes. Standard sizes may be available by storage volume (for example, gallon, half-gallon, quart, pint, etc.) or other names relating to suggested size (for example snack, sandwich, etc.). Dimensionally, bags having heights H1 and bag widths (in some examples, the width measurement corresponds to the bag top width W1 and in others to the bag bottom width W2) of about 3.25 inches by about 6.5 inches, about 5.875 inches by about 6.5 inches, of about 8 inches by about 7 inches, and of about 11 inches by about 10.5 inches are contemplated. In some examples, height and width measurements may be reversed. Other dimensions are contemplated.

The front lip 24 includes a front tab 40 that extends upward. The rear lip 22 includes a rear tab 56 extending upward. In some examples, the front tab 40 and rear tab 56 are the same size (that is, based on width and length). The front tab 40 and rear tab 56 may be rectangular, square, trapezoidal, triangular, or rhombic in shape. In some examples, the front tab 40 and rear tab 56 form unitary parts with the front lip 24 and rear lip 22, respectively. In other examples, the front tab 40 and rear tab 56 are each fastened to the front lip 24 and rear lip 22, respectively. The front tab 40 and rear tab 56 may each be over-molded onto the front lip 24 and rear lip 22, respectively. The front tab 40 and rear tab 56 may be formed of the same material(s) as the front lip 24 and rear lip 22, respectively. In some examples, the front tab 40 and rear tab 56 are formed of material(s) that are flexible and more rigid than the material(s) of the flexible pouch. The front tab 40 and rear tab 56 may include acrylonitrile butadiene styrene (ABS) or a similar polymer. The thickness of each of the front tab 40 and rear tab 56 may be about 0.06 inches. The thickness of each of the front tab 40 and rear tab 56 may be between about 0.04 inches and 0.08 inches. The thickness of each of the front tab 40 and rear tab 56 may be between about 0.05 inches and 0.07 inches. The thickness of each of the front tab 40 and rear tab 56 may be between about 0.04 inches and 0.1 inches. The thickness of each of the front tab 40 and rear tab 56 may be between about 0.02 inches and 0.08 inches. The thickness of each of the front tab 40 and rear tab 56 may be greater than about 0.03 inches. The thickness of each of the front tab 40 and rear tab 56 may be greater than about 0.02 inches. The thickness of each of the front tab 40 and rear tab 56 may be less than about 0.09 inches. The thickness of each of the front tab 40 and rear tab 56 may be less than about 0.1 inches. Other dimensions are contemplated.

The front tab 40 has a front tab width W3 parallel to axis X when the bag is closed. The rear tab 56 has a rear tab width W4 parallel to axis X when the bag is closed. Each of the front tab width W3 and the rear tab width W4 are less than the top bag width W1. In the depicted example, front tab width W3 and rear tab width W4 are equal. In other examples, however, the front tab width W3 and rear tab width W4 may be different for different aesthetic or other purposes. As described elsewhere herein, the rear tab 56 may be pushed with a user's thumb while the front tab is pushed in an opposite direction with the fingers. This may make a narrower rear tab 56 and a wider front tab 40 potentially desirable. Other reasons to vary the widths of the tabs would be apparent to a person of skill in the art. In some examples, at least a portion of front tab 40 and at least a portion of rear tab 56 are each positioned on both sides of a vertical Y-Z plane.

Figure 3:
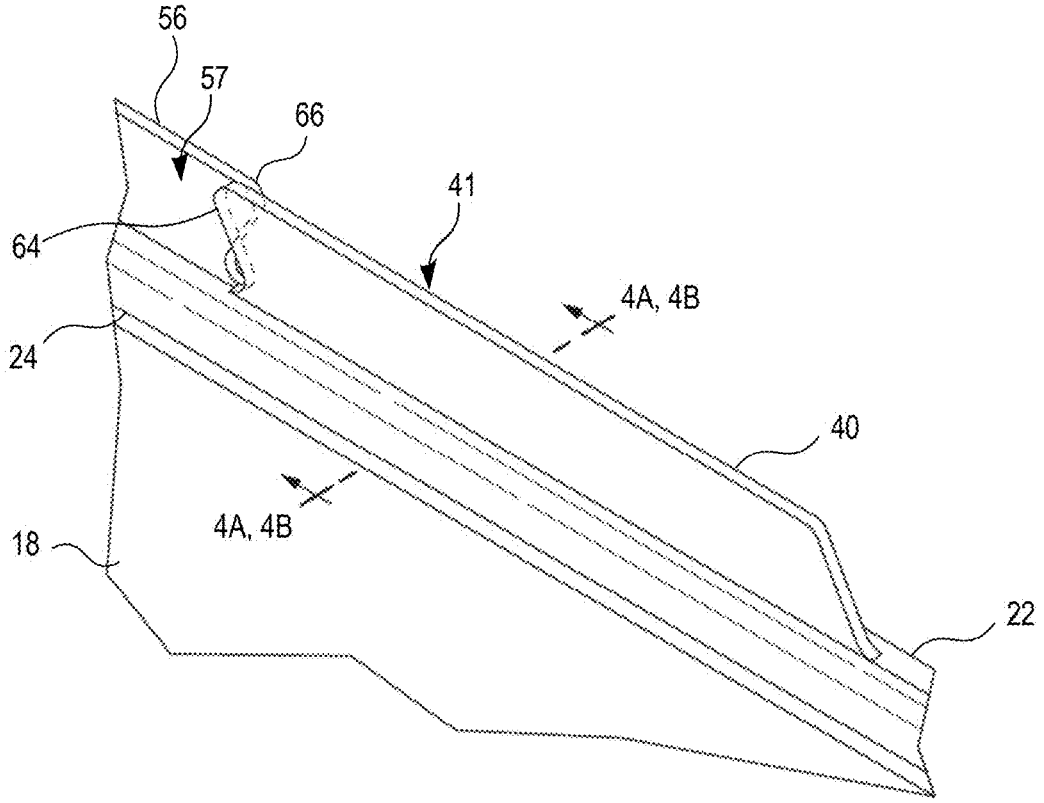
FIG. 3 illustrates a section of the top perspective view of the storage bag of FIG. 1.
Figure 4A:
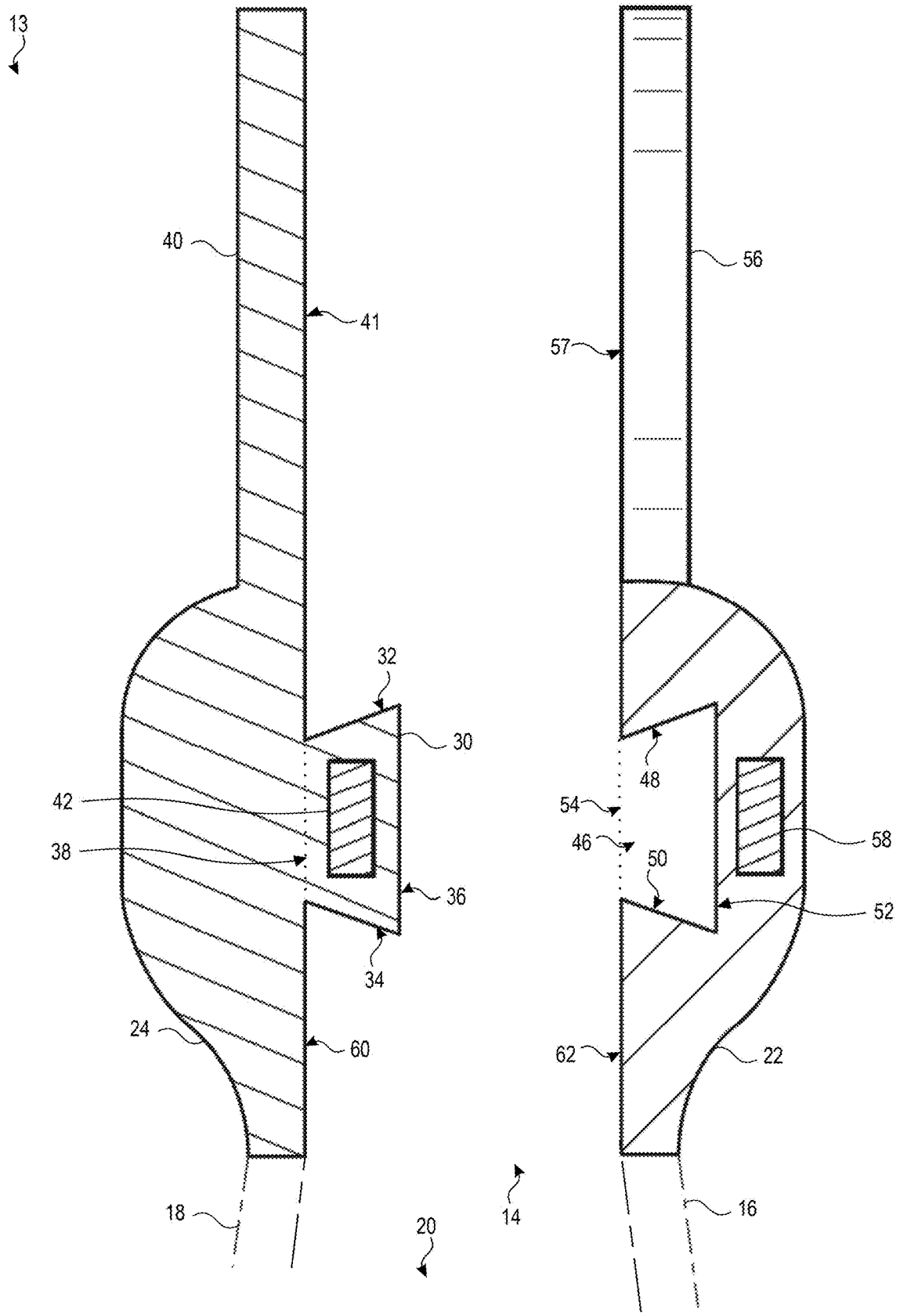
FIG. 4A illustrates a cross-sectional view of front and rear lips of the storage bag of FIG. 1.
Figure 4B:
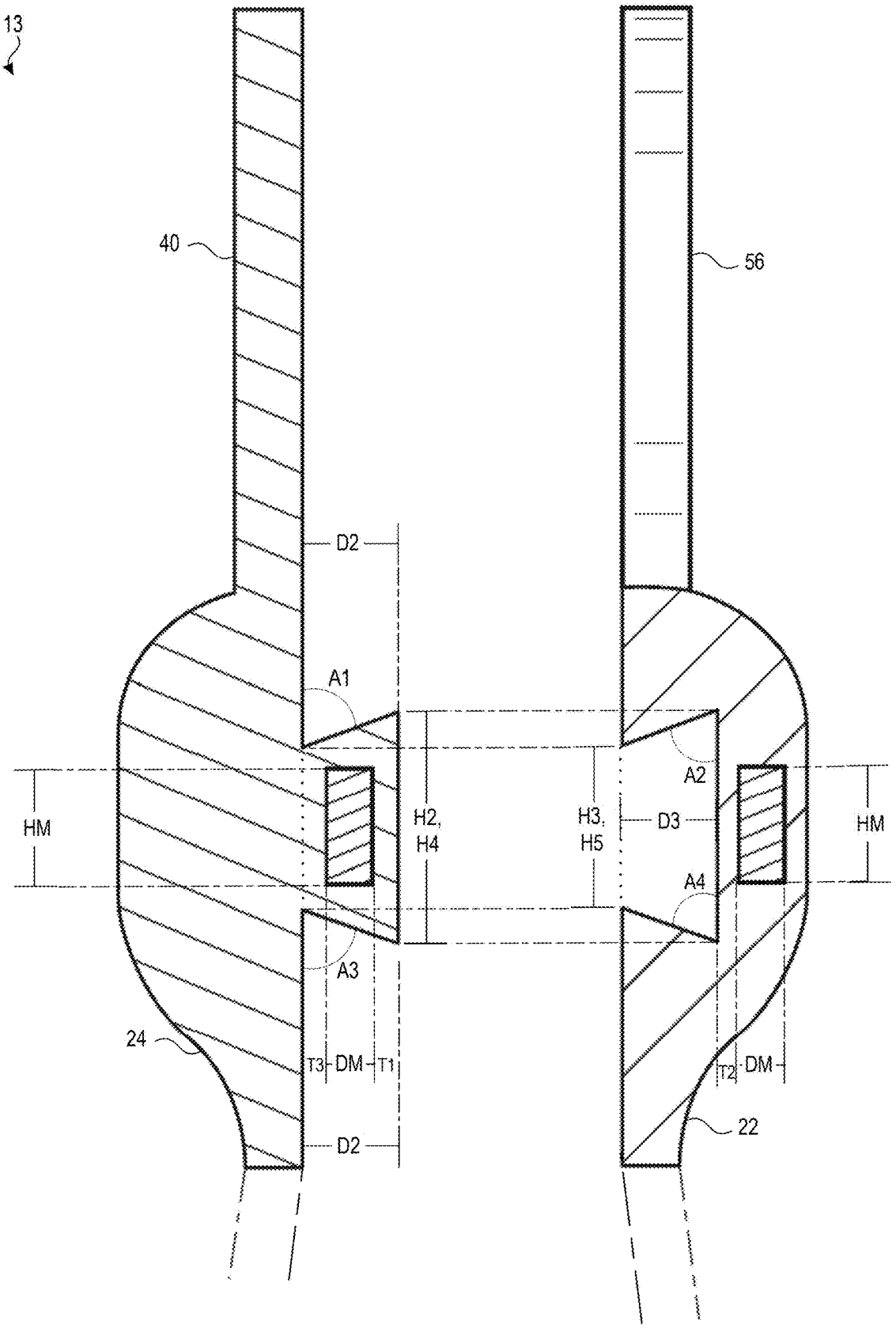
FIG. 4B illustrates dimensions of the cross-sectional view of FIG. 4A.

FIG. 3 illustrates a section of the top perspective view of the sealable storage bag 10 and shows the location of the cross-sectional views of FIG. 4A and FIG. 4B. Front tab 40 and rear tab 56 include a rear surface of the front tab 41 and a front surface of the rear tab 57 that face each other at least when the storage bag 10 is open. A portion of the rear surface of the front tab 41 and a front surface of the rear tab 57 may contact one another along the X-Y plane when the storage bag 10 is closed. In the example shown, front tab 40 and rear tab 56 each have a tip portion 64 and 66 respectively that overlap so that they sit one in front of/behind the other. In other possible examples, one or both of front tab 40 and rear tab 56 may be shaped or oriented differently so that no part of each tab overlaps with another part of each tab.

FIG. 4A illustrates a cross-sectional view of a seal assembly 13 (including front and rear lips) of the storage bag 10. FIG. 4B illustrates dimensions of the cross-sectional view of FIG. 4A. FIGS. 4A and 4B are described concurrently and not all components described are visible in both FIG. 4A and FIG. 4B.

Tongue 30 is attached to front lip 24 at a trailing edge 38. In examples, tongue 30 is formed as a unitary part with front lip 24, but may also be attached thereto with, e.g., a chemical adhesive, ultrasonic welding, or other attachment types. When the storage bag 10 is closed, trailing edge 38 is oriented along the X-Y plane. Opposite trailing edge 38, tongue 30 includes a leading edge 36 that may be parallel to the trailing edge 38. Leading edge 36 has a leading edge height H2 that is greater than a trailing edge height H3 of the trailing edge 38. The distance between the leading edge 36 and the trailing edge 38 defines the tongue depth D2. Tongue 30 includes an upper engaging surface 32 and a lower engaging surface 34 that protrude from a front lip contact surface 60 at upper engaging angle A1 and lower engaging angle A3, respectively.

Groove 46 is bounded by an open mouth 54, a base 52, an upper receiving surface 48, and a lower receiving surface 50. When the storage bag 10 is closed, mouth 54 is oriented along the X-Y plane. Base 52 is located opposite and, in examples, parallel to mouth 54. Base 52 is parallel to leading edge 36, and is in contact with leading edge 36 when the storage bag 10 is sealed and the tongue 30 is within groove 46. Base 52 has a base height H4 that is greater than a mouth height H5 of mouth 54. Base height H4 is equal to leading edge height H2, and mouth height H5 is equal to trailing edge height H3. In some examples, the mouth height is approximately 70% of the base height. In other examples, the mouth height is less than or greater to approximately 70% of the base height. The distance between the base 52 and the mouth 54 defines the groove depth D3. Groove depth D3 is equal to tongue depth D2. While the various dimensions described above are indicated to be "equal," the desirability of minor variations due to manufacturing tolerances and/or other considerations would be apparent to a person of skill in the art. For example, groove depth D3 may be slightly greater than tongue depth D2, so as to maintain tension on the tongue 30 within the groove 46.

Upper receiving surface 48 and lower receiving surface 50 are recessed into rear lip contact surface 62 at upper receiving angle A2 and lower receiving angle A4, respectively. Upper engaging surface 32 is parallel to upper receiving surface 48 and is in contact with upper receiving surface 48 when the storage bag 10 is sealed and the tongue 30 is within groove 46. Lower engaging surface 34 is parallel to lower receiving surface 50 and is in contact with lower receiving surface 50 when the storage bag 10 is sealed and the tongue 30 is within groove 46. Upper receiving angle A2 and upper engaging angle A1 are equivalent angles. Lower receiving angle A4 and lower engaging angle A3 are equivalent angles. In some examples, upper engaging angle A1 and lower engaging angle A3 are equal, and upper receiving angle A2 and lower receiving angle A4 are equal. When the storage bag 10 is closed, front lip contact surface 60 and rear lip contact surface 62 contact one another and define a sealing interface 68 along the X-Y plane.

Tongue 30 includes a plurality of front magnets 42 disposed within the tongue 30 adjacent to the leading edge 36. Groove 46 includes a plurality of rear magnets 58 within the groove 46 adjacent to the base 52. Each of the front magnets 42 aligns with a corresponding one of the rear magnets 58 to form pairs of magnets that are magnetically engaged when the storage bag 10 is sealed and the tongue 30 is within groove 46. When the storage bag 10 is sealed and the tongue 30 is within the groove 46, the front magnets 42 and the rear magnets 58 are located on a rear side of the sealing interface 68, the sealing interface 68 being aligned with the X-Y plane. This is depicted more clearly in the portion of FIG. 5 associated with operation 502, below. Such a configuration that includes pairs of front and rear magnets 42, 58 may advantageously contribute to reliable and secure sealing of the tongue 30 within the groove 46 that does not need external force applied. The materials of the tongue 30 and groove 46 are pressed/drawn together by the magnetic forces to create a secure closure (thus reducing or eliminating both leaks of stored contents out of the bag and air entering the bag).

The tongue depth D2 is such that the thickness T1 of material between the leading edge 36 and a front magnet 42 may be equal to about half of the magnet depth DM. the various thicknesses T1, T2, and/or T3 may each be any thickness as required or desired for a particular application, and may be equal to or different than one another. For example, either or both of thickness T1 and thickness T2 may have a thickness of one-half, or less than one-half of the magnet depth DM. In other examples, either or both of T1 and T2 may have thickness of greater than one-half of the magnet thickness DM. In particular examples, any of thicknesses T1, T2, or T3 may be about 0.02 inches. In some examples, any of the thicknesses may be between about 0.01 inches and about 0.03 inches. In other examples, any of the thicknesses may be greater than 0.02 inches. In some examples, any of the thicknesses may be less than 0.02 inches. In some examples, DM may be equal to about 2 millimeters. In some examples, DM may be between about 1 millimeter and about 3 millimeters. In some examples, DM may be between about 1 millimeter and about 4 millimeters. In some examples, DM may be greater than about 1 millimeter. In some examples, DM may be less than about 5 millimeters. In some examples, DM may be less than about 4 millimeters. In some examples, each magnet has a height HM. In some examples, HM may be equal to about 6 millimeters. In some examples, HM may be between about 5 millimeter and about 7 millimeters. In some examples, HM may be between about 3 millimeter and about 9 millimeters. In some examples, HM may be greater than about 3 millimeters. In some examples, HM may be greater than about 4 millimeters. In some examples, HM may be less than about 5 millimeters. In some examples, DM may be less than about 9 millimeters.

In some examples, when the front magnets 42 and/or the rear magnets 58 are manufactured into the storage bag 10, they are in a first unmagnetized state. The front magnets 42 and/or the rear magnets 58 may then be magnetized by an appropriate part of the manufacturing process so that they are in a second, activated, magnetized state.

Figure 5A:
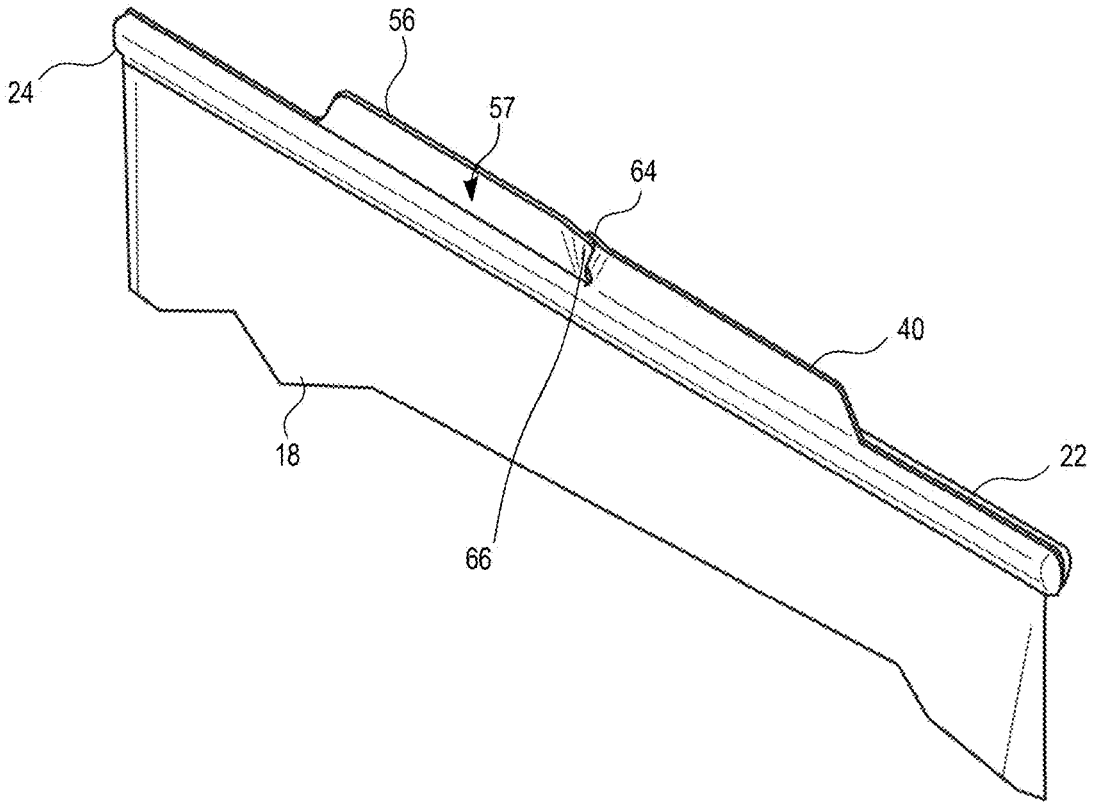
FIG. 5A illustrates a partial top perspective view of storage bag, according to another example.
Figure 5B:
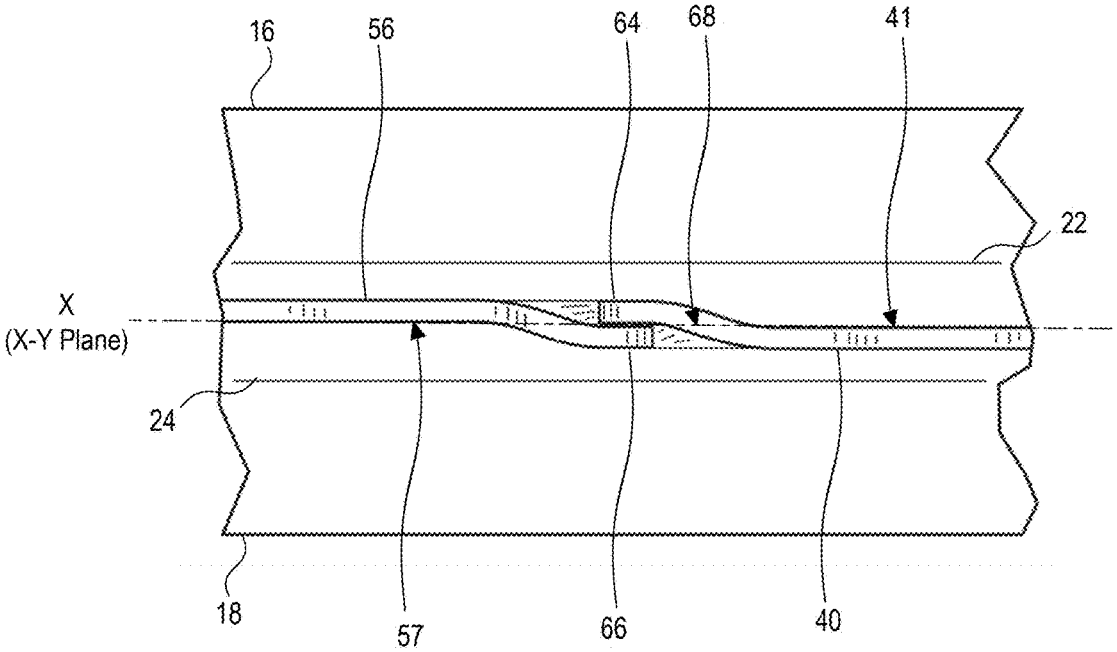
FIG. 5B illustrates a top view of the storage bag of FIG. 5A.

FIG. 5A illustrates a partial the top perspective view of another example of a storage bag 10. For clarity, reference numerals consistent with those used in FIG. 1 are utilized in FIGS. 5A and 5B. FIG. 5B illustrates a top-down view of the section view of FIG. 5A. FIGS. 5A and 5B are described concurrently and not all components described are visible in both FIG. 5A and FIG. 5B. Notably, and distinct from FIG. 1, FIGS. 5A and 5B depict the front tab tip portion 64 and rear tab tip portion 66 in a crosswise engaged position. Such a crosswise engaged position may help keep the storage bag closed (as will be described more regarding FIG. 6), and may provide additional resistance to forces trying to open the bag, therefore reducing accidental opening and subsequent leaking. In the example shown in FIGS. 5A and 5B, tip portion 64 of the front tab 40 may be disposed behind a tip portion 66 of the rear tab 46. In such crosswise engaged positions, the front tab tip portion 64 is at least partially to the rear of the X-Y plane and scaling interface 68, and the rear tab tip portion 66 is at least partially in front of the X-Y plane and the sealing interface 68. In this configuration, at least a portion of the front tab 40 and at least a portion of the rear tab 46 are each positioned on both sides of the vertical X-Y plane.

Figure 6:
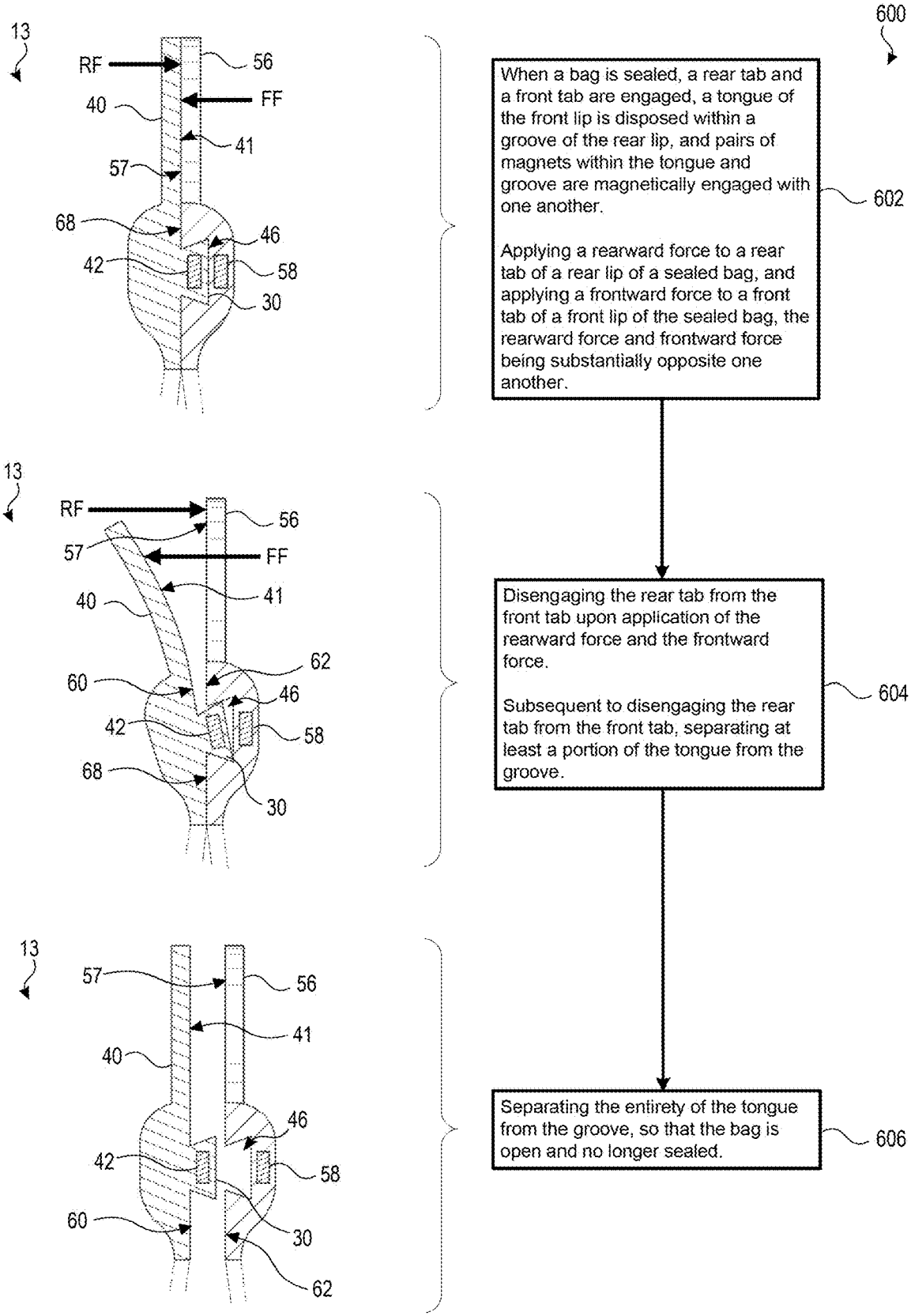
FIG. 6 illustrates an example method for opening the sealable storage bag of FIG. 1.

FIG. 6 illustrates a method 600 for opening the sealable storage bag 10 as described in the previous Figures. Not all elements described are depicted in FIG. 6; as such, the following description may also be read in conjunction with FIGS. 1 through 5B. At operation 602, when the storage bag 10 is sealed, the tongue 30 is within the groove 46, the upper engaging surface 32 is mated with the upper receiving surface 38, the lower engaging surface 34 is mated with the lower receiving surface 50, and each of the front magnets 42 aligns with a corresponding one of the rear magnets 58 to form pairs of magnets that are magnetically engaged.

A rearward force RF is applied to a front surface 57 of rear tab 56, and a frontward force FF is applied to a rear surface 41 of the front tab 40. In some examples, rearward force RF and frontward force FF are applied in substantially opposite directions from one another. In some examples, rearward force RF and frontward force FF are applied in the absence of any forces being applied to a front surface 43 of the front tab 40 and/or to a rear surface 59 of the rear tab 56. That is, the absence of an opposing force on the same tab 40, 56 is an indication that the tab 40, 56 is not being pinched with the fingers; rather, it is simply being pushed or pulled by the application of force to a single surface thereof. Of course, a user may choose to pinch one or more of the tabs 40, 56, if desired. In some examples, the configuration of the front tab 40 and rear tab 56 is such that a user may apply both frontward force FF and rearward force RF using one hand. For example, a user may apply rearward force RF with a thumb and forward force FF with a portion of a finger on the same hand, or vice versa. Such a configuration has particular advantages, because the storage bag 10 may be opened easily by a user with one hand without exerting strenuous pressure. As described above, when the front tab 40 and rear tab 56 are formed of material(s) that are more rigid than the material(s) of the flexible pouch 12, they are strong enough to push the more flexible pouch 12 material open with little pressure.

At operation 604, upon application of the frontward force FF and rearward force RF, the rear tab 56 begins to become disengaged from the front tab 40. An upper portion of the front lip contact surface 60 becomes separated from an upper portion of the rear lip contact surface 62. At least a portion of the tongue 30 becomes separated from at least a portion of the groove 46. For example, upper engaging surface 32 may become disengaged from (e.g., may lose scalable contact with) upper receiving surface 48. In some examples, a portion of the tongue 30 located near rear lip first end 26*a*, front lip first end 26*b*, rear lip second end 28*a*, and front lip second end 28*b* may become at least partially disengaged from the groove 46 prior to a portion of the tongue 30 located nearer to the Y-X axis (the center of the bag along W1). The engaged pairs of front magnets 42 and corresponding rear magnets 58 may begin to become disengaged. In some examples, pairs of front magnets 42 and rear magnets 58 that are located near rear lip first end 26*a*, front lip first end 26*b*, rear lip second end 28*a*, and front lip second end 28*b* may become disengaged prior to pairs of front magnets 42 and rear magnets 58 that are located nearer to the Y-X axis (the center of the bag along W1).

In order to result in disengagement and ultimate separation of the tongue 30 from the groove 46, the combination of the applied frontward force FF and rearward force RF must overcome: the interaction between the front tab tip portion 64 and rear tab tip portion 66 (if they are crosswise engaged); friction and material properties of the tongue 30 within the groove 46; and the magnetic forces between the engaged front magnets 42 and rear magnets 58.

At operation 606, continued application of the frontward force FF and rearward force RF causes separation of the entirety of the tongue 30 from the groove 46, so that the storage bag 10 is open and no longer sealed. A lower portion of the front lip contact surface 60 becomes separated from a lower portion of the rear lip contact surface 62. A user may now place materials into or remove materials from the interior volume 20 of the storage bag 10.

In some examples, upon termination of application of the frontward force FF and the rearward force RF, the magnetic forces between the front magnets 42 and the rear magnets 58 pulls the tongue 30 into the groove 46 so that both pairs of magnets 42, 58 are behind the X-Y plane, the front lip contact surface 60 contacts the rear lip contact surface 62 along the sealing interface 68, and the storage bag 10 is resealed. In some examples, a portion of the tongue 30 located near rear lip first end 26*a*, front lip first end 26*b*, rear lip second end 28*a*, and front lip second end 28*b* may become at least partially reengaged within the groove 46 prior to a portion of the tongue 30 located nearer to the Y-X axis (the center of the bag along W1). In some examples, pairs of front magnets 42 and rear magnets 58 that are located near rear lip first end 26*a*, front lip first end 26*b*, rear lip second end 28*a*, and front lip second end 28*b* may become reengaged prior to pairs of front magnets 42 and rear magnets 58 that are located nearer to the Y-X axis (the center of the bag along W1).

Figure 7:
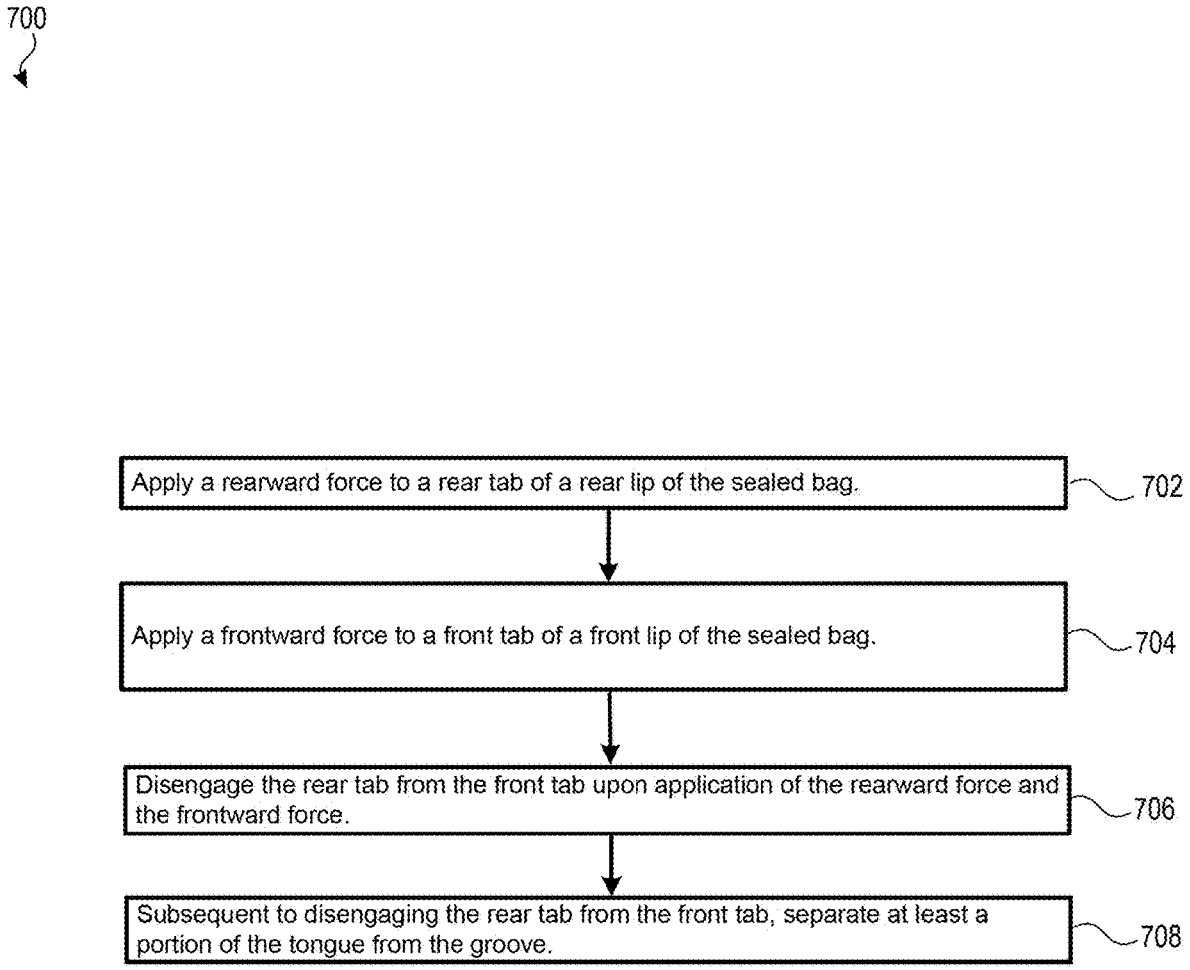
FIG. 7 illustrates another method for opening a sealed storage bag.

FIG. 7 illustrates a method 700 for opening a sealed storage bag. At operation 702, rearward force is applied to a rear tab of a rear lip of the sealed bag. In examples, the real lip may be configured as described herein. That is, the rear lip may include a groove and a plurality of rear magnets disposed adjacent a base of the groove.

At operation 704, a frontward force is applied to a front tab of a front lip of the sealed bag. In examples, the front lip may be configured as described herein and includes a tongue disposed within the groove, and a plurality of front magnets disposed adjacent a leading edge of the tongue. Each one of the plurality of front magnets is magnetically engaged with a corresponding one of the plurality of rear magnets. Prior to applying the rearward force and the frontward force, at least a portion of the rear tab is disposed in front of at least a portion of the front tab. The frontward force is applied in a direction substantially opposite to and offset from to the rearward force.

Upon application of the rearward force and the frontward force, an upper engaging surface of the tongue is disengaged from an upper receiving surface of the groove, for example, as depicted in FIG. 6, above. This disengagement may include separating an upper portion of a front contact surface of the front lip (located above the tongue) from an upper portion of a rear contact surface of the rear lip (located above the groove).

Operations 702 and 704, applications of the frontward and rearward forces also result in other conditions. For example, at operation 706, the rear tab is disengaged from the front tab upon application of the rearward force and the frontward force. This may disengage the crosswise interaction of the front tab and the rear tab that may be present when the bag is sealed (e.g., as depicted in FIGS. 5A and 5B).

At operation 708, subsequent to disengaging the rear tab from the front tab, at least a portion of the tongue is separated from the groove. The separated portion is disposed between the rear tab and the front tab. In some examples, at least one pair of the plurality of front magnets and plurality of rear magnets are disengaged from each other. In some examples, when application of the rearward force and the frontward force is terminated, the tongue is caused to be magnetically engaged within the groove.

Figure 8:
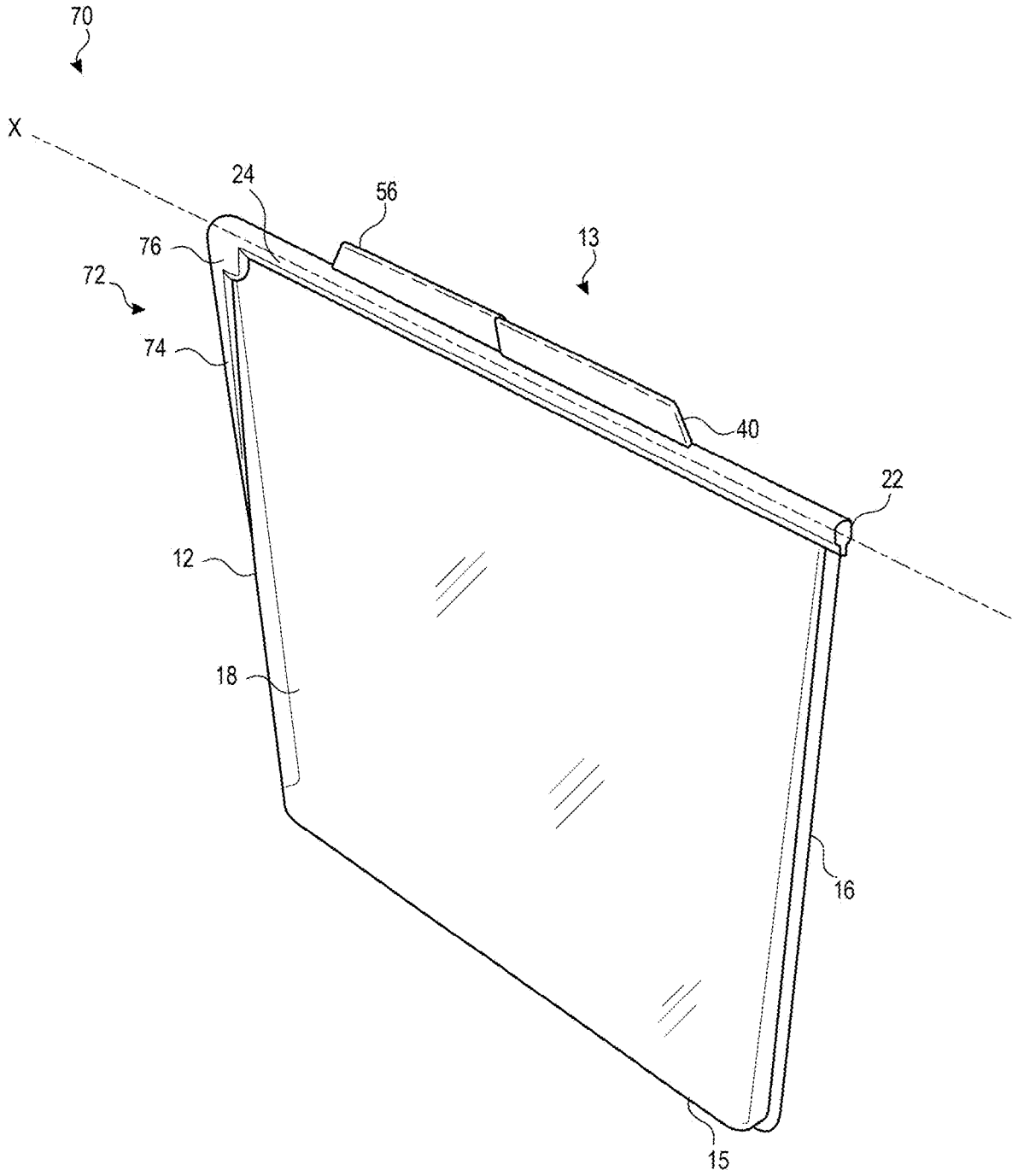
FIG. 8 illustrates a top perspective view of a sealable storage bag in a closed configuration, according to another example.

FIG. 8 illustrates a top perspective view of another example of a scalable storage bag 70 in a closed configuration that includes a side seal assembly 72. Rear lip 22 and front lip 24 may extend around to a side of the sealable storage bag 70 to form a pair of front and rear side lips 74 of the side seal assembly 72. Each of the pair of side lips 74 may include the features described above regarding the pair of rear lip 22 and front lip 24. A front lip of side lips 74 is attached to the front side 18 of the flexible pouch 12, and a rear lip of side lips 74 is attached to the rear side 16 of the flexible pouch 12. Securing feature 76 is located at the junction of the pair of side lips 74 and the rear lip 22 and front lip 24. Securing feature 76 may be a snap, button, hook, or other type of closure.

When the scalable storage bag 70 is opened (for example, due to pressure applied to front tab 40 and rear tab 56 as described above), if securing feature 76 is in a secured position, rear lip 22 and front lip 24 will separate but the pair of side lips 74 will remain engaged, and only the open top 14 of the flexible pouch 12 will open. If securing feature 76 is in an unsecured position, rear lip 22 and front lip 24 will separate first, and subsequently the pair of side lips 74 will disengage and separate, and the open top 14 and an open side of the flexible pouch 12 will open.

Figure 9:
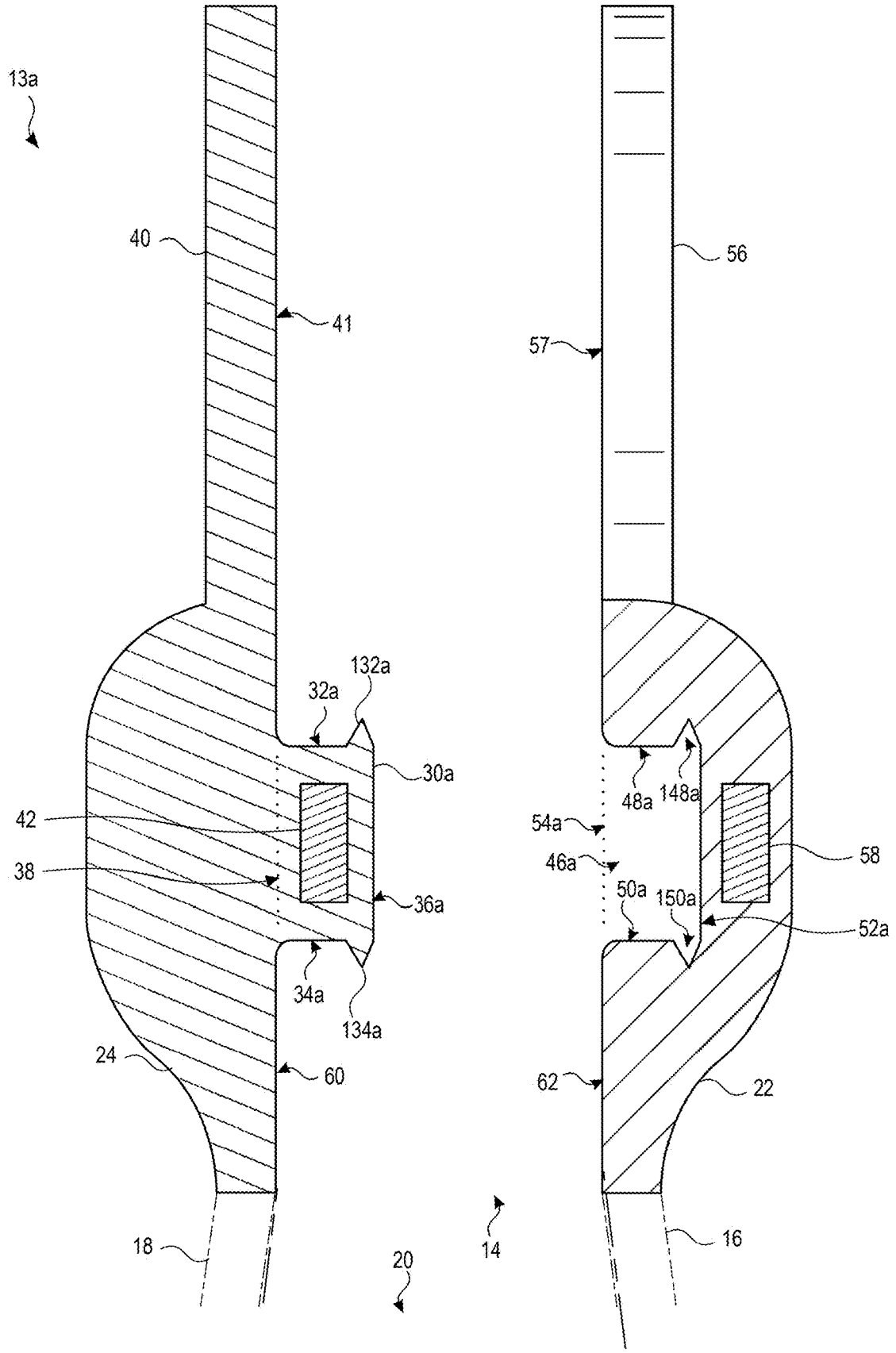
FIG. 9 illustrates a cross-sectional view of another example of a seal assembly.

FIG. 9 illustrates a cross-sectional view of another example of a seal assembly 13*a* (including front and rear lips). Tongue 30*a* is attached to front lip 24 at a trailing edge 38. In examples, tongue 30*a* is formed as a unitary part with front lip 24, but may also be attached thereto with, e.g., a chemical adhesive, ultrasonic welding, or other attachment types. When the storage bag is closed, trailing edge 38 is oriented along the X-Y plane. Opposite trailing edge 38, tongue 30*a* includes a leading edge 36*a* that may be parallel to the trailing edge 38. Tongue 30*a* includes an upper engaging surface 32*a* and a lower engaging surface 34*a* that protrude from a front lip contact surface 60. Upper engaging surface 32*a* and/or lower engaging surface 34*a* may include one or more engagement features 132*a*, 134*a*, respectively. Engagement features 132*a*, 134*a* may include protrusions, points, bumps, catches, tabs, or other suitable features.

Groove 46*a* is bounded by an open mouth 54*a*, a base 52*a*, an upper receiving surface 48, a and a lower receiving surface 50*a*. When the storage bag is closed, mouth 54*a* is oriented along the X-Y plane. Base 52*a* is located opposite and, in examples, parallel to mouth 54*a*. Base 52*a* is parallel to leading edge 36*a*, and is in contact with leading edge 36*a* when the storage bag is sealed and the tongue 30*a* is within groove 46*a*.

Upper receiving surface 48*a* and lower receiving surface 50*a* are recessed into rear lip contact surface 62. Upper receiving surface 48*a* and/or lower receiving surface 50*a* may include one or more receiving features 132*a*, 134*a*, respectively, for receiving engagement features 132*a*, 134*a*, respectively, when the storage bag is closed. Features 148*a*, 150*a* may include shapes suitable to accommodate and removably hold engagement features 132*a*, 134*a* (for example, grooves, detents, indents, recesses, or other features of suitable shape and size). When the storage bag is closed, front lip contact surface 60 and rear lip contact surface 62 contact one another and define a sealing interface along the X-Y plane.

In accordance with principles of this disclosure, materials of construction for the storage bag 10 and its components as described herein include materials that are compatible with the environment, materials to be contained, cleaning and sanitizing considerations, and use of storage bag 10.

For the purposes of this application, the depicted axes, along with terms such as "upper," "lower," "front," "rear," "upward," "downward" "frontward," and "rearward" are intended to be descriptive with reference to and in relation to the orientation shown in the Figures for clarity, but the examples as practiced and included in the scope of the claims may include examples where the systems and devices are in a different orientation.

While particular uses of the technology have been illustrated and discussed above, the disclosed technology can be used with a variety of environments in accordance with many examples of the technology. The above discussion is not meant to suggest that the disclosed technology is only suitable for implementation within the environments shown and described above.

This disclosure described some aspects of the present technology with reference to the accompanying drawings, in which only some of the possible aspects were shown. Other aspects can, however, be embodied in many different forms and should not be construed as limited to the aspects set forth herein. Rather, these aspects were provided so that this disclosure was thorough and complete and fully conveyed the scope of the possible aspects to those skilled in the art. As should be appreciated, the various aspects described with respect to the figures herein are not intended to limit the technology to the particular aspects described. Accordingly, additional configurations can be used to practice the technology herein and/or some aspects described can be excluded without departing from the methods and systems disclosed herein.

Similarly, where operations of a process are disclosed, those operations are described for purposes of illustrating the present technology and are not intended to limit the disclosure to a particular sequence of operations. For example, the operations can be performed in differing order, two or more operations can be performed concurrently, additional operations can be performed, and disclosed operations can be excluded without departing from the present disclosure. Further, each operation can be accomplished via one or more sub-operations. The disclosed processes can be repeated.

Although specific aspects were described herein, the scope of the technology is not limited to those specific aspects. One skilled in the art will recognize other aspects or improvements that are within the scope of the present technology. Therefore, the specific structure, acts, or operations are disclosed only as illustrative aspects. The scope of the technology is defined by the following claims and any equivalents therein. Examples of the disclosure may be described according to the following aspects.

Aspect 1. A storage bag comprising: a flexible pouch comprising an open top defined by two sides of the flexible pouch; and a seal assembly secured to the open top of the pouch, the seal assembly comprising: a pair of lips, wherein each lip of the pair of lips is secured to one side of the open top of the pouch, and wherein the pair of lips are joined together at a first end and a second end of each lip of the pair of lips, wherein the pair of lips comprises: a front lip comprising: a tongue extending along the front lip, the tongue comprising an upper engaging surface, a lower engaging surface, a leading edge, and a trailing edge, wherein the tongue is attached to the front lip at the trailing edge, and wherein the leading edge has a leading edge height that is greater than a trailing edge height; a front tab extending from the front lip; and a plurality of front magnets disposed within the tongue adjacent to the leading edge of the tongue; and a rear lip comprising: a groove extending along the rear lip, the groove comprising an upper receiving surface, a lower receiving surface, a base, and a mouth having a mouth height less than a base height of the base; a rear tab extending from of the rear lip; and a plurality of rear magnets disposed within the groove adjacent to the base of the groove, wherein each one of the plurality of front magnets aligns with a corresponding one of the plurality of rear magnets.

Aspect 2. The storage bag of aspect 1, wherein a front contact surface of the front lip and a rear contact surface of the rear lip contact at an interface.

Aspect 3. The storage bag of any of aspects 1-2, wherein when the tongue is disposed within the groove, the plurality of front magnets and the plurality of rear magnets are located on a first side of the interface.

Aspect 4. The storage bag of any of aspects 1-3, wherein when the tongue is disposed within the groove, the upper engaging surface mates with the upper receiving surface, the lower engaging surface mates with the lower receiving surface, and the leading edge engages with the base.

Aspect 5. The storage bag of any of aspects 1-4, wherein the front tab comprises a front tab width less than a front lip width of the front lip, and wherein the rear tab comprises a rear tab width less than a rear lip width of the rear lip.

Aspect 6. The storage bag of any of aspects 1-5, wherein the flexible pouch comprises a closed bottom.

Aspect 7. The storage bag of any of aspects 1-6, further comprising a vertical axis, wherein at least a portion of the front tab and at least a portion of the rear tab are each positioned on both sides of the vertical plane.

Aspect 8. The storage bag of any of aspects 1-7, wherein when the tongue is disposed within the groove, a portion of the front tab overlaps with a portion of the rear tab.

Aspect 9. The storage bag of any of aspects 1-8, wherein when the tongue is disposed within the groove, at least a portion of the rear tab is disposed in front of at least a portion of the front tab.

Aspect 10. The storage bag of any of aspects 1-9, wherein the front lip, the front tab, and the tongue comprise a unitary part, and wherein the rear lip and the rear tab comprise a unitary part, and wherein the rear lip defines the groove.

Aspect 11. The storage bag of any of aspects 1-10, wherein the tongue and groove each comprise a trapezoidal profile.

Aspect 12. The storage bag of any of aspects 1-11, wherein the mouth height is approximately 70% of the base height.

Aspect 13. A method of opening a sealed bag, the method comprising: applying a rearward force to a rear tab of a rear lip of the sealed bag, the rear lip comprising a groove and a plurality of rear magnets disposed adjacent a base of the groove; applying a frontward force to a front tab of a front lip of the sealed bag, the front lip comprising a tongue disposed within the groove, and a plurality of front magnets disposed adjacent a leading edge of the tongue, wherein each one of the plurality of front magnets is magnetically engaged with a corresponding one of the plurality of rear magnets, and wherein, prior to applying the rearward force and the frontward force, at least a portion of the rear tab is disposed in front of at least a portion of the front tab, and wherein the frontward force is applied in a direction substantially opposite to and offset from to the rearward force; disengaging the rear tab from the front tab upon application of the rearward force and the frontward force; and subsequent to disengaging the rear tab from the front tab, separating at least a portion of the tongue from the groove, wherein the separated portion is disposed between the rear tab and the front tab.

Aspect 14. The method of aspect 13, further comprising upon application of the rearward force and the frontward force, disengaging an upper engaging surface of the tongue from an upper receiving surface of the groove.

Aspect 15. The method of any of aspects 13-14, further comprising upon application of the rearward force and the frontward force, separating an upper portion of a front contact surface of the front lip from an upper portion of a rear contact surface of the rear lip, wherein the upper portion of the front contact surface is located above the tongue, and wherein the upper portion of the rear contact surface is located above the groove.

Aspect 16. The method of any of aspects 13-15, further comprising disengaging at least one pair of the plurality of front magnets and plurality of rear magnets.

Aspect 17. The method of any of aspects 13-16, further comprising terminating application of the rearward force and the frontward force, wherein the termination magnetically engages the tongue within the groove.

What is claimed is:

1. A storage bag comprising:

a flexible pouch comprising an open top defined by two sides of the flexible pouch; and a seal assembly secured to the open top of the pouch, the seal assembly comprising:

a pair of lips, wherein each lip of the pair of lips is secured to one side of the open top of the pouch, and wherein the pair of lips are joined together at a first end and a second end of each lip of the pair of lips, wherein the pair of lips comprises:

a front lip comprising:

a tongue extending along the front lip, the tongue comprising an upper engaging surface, a lower engaging surface, a leading edge, and a trailing edge, wherein the tongue is attached to the front lip at the trailing edge, and wherein the leading edge has a leading edge height that is greater than a trailing edge height;

a front tab extending from the front lip; and a plurality of front magnets disposed within the tongue adjacent to the leading edge of the tongue; and a rear lip comprising:

a groove extending along the rear lip, the groove comprising an upper receiving surface, a lower receiving surface, a base, and a mouth having a mouth height less than a base height of the base;

a rear tab extending from of the rear lip; and a plurality of rear magnets disposed within the groove adjacent to the base of the groove, wherein each one of the plurality of front magnets aligns with a corresponding one of the plurality of rear magnets.

2. The storage bag of claim 1, wherein a front contact surface of the front lip and a rear contact surface of the rear lip contact at an interface.

3. The storage bag of claim 1, wherein when the tongue is disposed within the groove, the plurality of front magnets and the plurality of rear magnets are located on a first side of the interface.

4. The storage bag of claim 1, wherein when the tongue is disposed within the groove, the upper engaging surface mates with the upper receiving surface, the lower engaging surface mates with the lower receiving surface, and the leading edge engages with the base.

5. The storage bag of claim 1, wherein the front tab comprises a front tab width less than a front lip width of the front lip, and wherein the rear tab comprises a rear tab width less than a rear lip width of the rear lip.

6. The storage bag of claim 1, wherein the flexible pouch comprises a closed bottom.

7. The storage bag of claim 1, further comprising a vertical axis, wherein at least a portion of the front tab and at least a portion of the rear tab are each positioned on both sides of the vertical plane.

8. The storage bag of claim 1, wherein when the tongue is disposed within the groove, a portion of the front tab overlaps with a portion of the rear tab.

9. The storage bag of claim 1, wherein when the tongue is disposed within the groove, at least a portion of the rear tab is disposed in front of at least a portion of the front tab.

10. The storage bag of claim 1, wherein the front lip, the front tab, and the tongue comprise a unitary part, and wherein the rear lip and the rear tab comprise a unitary part, and wherein the rear lip defines the groove.

11. The storage bag of claim 1, wherein the tongue and groove each comprise a trapezoidal profile.

12. The storage bag of claim 1, wherein the mouth height is approximately 70% of the base height.

* * * * *